United States Patent [19]

Shaktman

[11] Patent Number: 4,709,431

[45] Date of Patent: Dec. 1, 1987

[54] DUAL CROWNED HEMORRHOID SUPPORT SEAT CUSHION

[76] Inventor: Donald H. Shaktman, 1800 NE. 114th St., Apt. 910, Miami, Fla. 33181

[21] Appl. No.: 803,483

[22] Filed: Dec. 2, 1985

[51] Int. Cl.[4] ..... A47C 27/14; A47C 27/22; A61F 5/34; A61G 7/04

[52] U.S. Cl. ..... 5/481; 5/431; 128/78; 128/98.1; 297/DIG. 1

[58] Field of Search ..... 5/448, 481, 464, 431, 5/434, 436; 297/457, 458, DIG. 1, 283; 128/132 R, 98, 149, 68; D6/596, 601

[56] References Cited

U.S. PATENT DOCUMENTS

| | | | |
|---|---|---|---|
| 2,150,287 | 3/1939 | Minor | 5/464 |
| 2,249,298 | 7/1941 | Ratti | 128/98 X |
| 2,470,398 | 5/1949 | Hayes | 5/464 |
| 2,615,445 | 10/1952 | Holmes | 128/98 X |
| 2,769,185 | 11/1956 | Biederman | 5/436 |
| 2,970,638 | 2/1961 | Halter | 297/458 |
| 3,158,878 | 12/1964 | Pernell | 128/68 X |
| 3,463,547 | 8/1969 | Brennan et al. | 297/458 |
| 3,503,649 | 3/1970 | Johnson | 297/458 |
| 3,611,455 | 10/1971 | Gottfried | 128/68 |
| 3,716,270 | 2/1973 | Frazier | 297/460 |
| 3,749,442 | 7/1973 | Berg et al. | 297/458 |
| 3,829,917 | 8/1974 | De Laittre et al. | 5/434 |
| 4,132,228 | 1/1979 | Green | 128/68 |
| 4,522,447 | 6/1985 | Snyder et al. | 297/DIG. 1 |
| 4,660,238 | 4/1987 | Jay | 5/431 |

FOREIGN PATENT DOCUMENTS

| | | | |
|---|---|---|---|
| 2358132 | 5/1975 | Fed. Rep. of Germany | 5/481 |
| 2522375 | 12/1976 | Fed. Rep. of Germany | 5/441 |
| 352384 | 1/1940 | France | 5/481 |
| 1271660 | 8/1961 | France | 297/458 |

*Primary Examiner*—Alexander Grosz
*Assistant Examiner*—Carl M. DeFranco, Jr.
*Attorney, Agent, or Firm*—Robert M. Schwartz; Edward I. Mates

[57] ABSTRACT

A hemorrhoid relief cushion is constructed with aligned, elongated, convexly elevated portions of different size to reduce inventory requirements by half and also reduce the number of fabrication molds needed for making a complete inventory of cushion sizes in half.

12 Claims, 4 Drawing Figures

DUAL CROWNED HEMORRHOID SUPPORT SEAT CUSHION

BACKGROUND OF THE INVENTION

1. Field of the Invention

This invention relates to cushions that support the buttocks of people suffering from hemorrhoids.

2. Technical Problems and Prior art

Many solutions have been proposed to relieve the pain and discomfort of hemorrhoids. These include the use of suppositories and other preparations that must be applied to the vicinity of the hemorrhoids. Not only are these messy and difficult to apply, but the alleged comfort they provide is only temporary, if any, and applications must be made frequently to renew any relief available from their use.

Special pads have been provided to relieve the pressure on the hemorrhoids. One type of pad in the form of a doughnut supports the buttocks in an elevated position above the seat on which the pad is mounted so that no pressure is applied against the hemorrhoids when a patient is seated thereon. However, this type of seat is unsuitable for use in autos where there is limited room beneath the steering wheel. Also, such doughnut shaped seats do not offer any back pressure to counteract the pressure of the blood vessels in the anus on hemorrhoids, which pressure causes discomfort.

U.S. Pat. No. 4,038,762 to Swan discloses viscous, flowable, pressure compensating fitting materials and their use in boots, but also states that such fitting materials may also be used in conjunction with cushioning structures, including devices or appliances which provide protection to parts of the human body by cushioning against pressure, impact or shock. In this patent, a preformed shape fitting pad of selected shape and construction is used. The pad comprises a flexible, protective enclosure having confined and retained therein a predetermined amount or volume of pressure-compensating fitting material with desired fitting and flow characteristics. The fitting pad retains the pressure-compensating fitting material and is shaped, constructed, and adapted to be positioned in an ankle-covering boot between the boot and the foot. Each fitting pad is custom fit to the customer. Such custom fitting is expensive and is inconvenient to develop in the case of hemorrhoid relief pads.

The Swan patent described in the previous paragraph is mentioned by Jay Medical, Ltd. in advertising literature for a product called a Maximus(TM) Hemorrhoid Relief Cushion. This product is essentially flat and includes an elevated portion that extends across substantially the entire width of the cushion to engage the creases between the buttocks of the user. Promotional material for this product states that it works to relieve the pain and swelling of hemorrhoids because of a patented Flolite(Registered TM) pad that is built into the cushion so that when a person sits down, fluid within the pad automatically conforms to the person's shape and exerts a slight but effective pressure on the hemorrhoids that actually counteracts the pressures in the veins around the anus. This provides support that no medication can give and is alleged to provide exactly the support a person needs to reduce the internal pressures that cause hemorrhoidal swelling and pain.

Also available at present are countoured modular seating systems sold under the trademark "ContourU" by Pindot Products, Chicago, IL. These systems have flat bottom surfaces and contoured upper surfaces and are available in 34 different sizes and are mounted on multiadjustable aluminum frameworks compatible with most wheelchairs.

Another product presently available is sold as the Helpmate(TM) wheelchair accessory seat made from durable thermoplastic in combination with a fully-cleanable, water and stain resistant Soft Seat(TM) foam cover by Formcare(TM) Products division of Gemini, Inc., Cannon Falls, MN. The seat has a contoured upper surface that includes a raised portion with a rounded top at the front portion of the seat to provide proper support and balance for a person sitting in a wheelchair.

Still another cushion available on the market is known as the BioThotic(TM) cushion, sold by American General Health Care, Valencia, CA. This latter cushion comprises a molded urethane base designed with a series of spaced, interacting pods and cones. The latter are readily modified and removable to provide additional relief for problem areas. A ventilated foam is incorporated to reduce heat buildup, to provide more comfort and to enhance pressure distribution. A washable cover of polypropylene is breathable, drawing moisture away from the skin to maintain healthy tissue. It is necessary to remove or modify certain pods and cones to develop a desired contour for the side of the seat that faces the sitter.

According to the teaching of the aforesaid prior art, it is either necessary to custom fit a hemorrhoid relief cushion for each individual to provide an expensive solution to the hemorrhoid problem or, as an alternative, to provide a cushion comprising a pad of pressure-compensating fitting material having an elevated portion of a given size prefabricated to an approximate height suitable for a person of a particular size and other pads of different standard sizes for people of other sizes. When cushions are prefabricated with elevated portions of different standard heights, an inventory of different standard sizes is required. This consumes sorely needed space of a distributor of such devices, and also requires a large number of molds to fabricate the many sizes of cushions needed for people of different size, namely, one for each standard size.

BRIEF DESCRIPTION OF THE INVENTION

This invention avoids the need to custom fit each hemorrhoid relief cushion to the exact contour of the individual user, thereby avoiding an expensive fabrication process for each hemorrhoid relief cushion user. This invention also reduces the number of molds needed to produce hemorrhoid relief cushions having elevated portions of different sizes to conform to a population of different size people by approximately one half.

According to this invention, each cushion comprises a pressure-compensating fitting pad composed of a spongy, thermoplastic composition that has requisite physical and chemical properties such that it conforms snugly to the shape of the buttocks and the crease between the buttocks of the user. The pad has a smooth major surface that is adapted to face a seat and a contoured major surface that is adapted to face the buttocks of the user. The pad of this invention may be composed of any material that has pressure relieving properties suitable to overcome discomfort due to pressure of veins applied to hemorrhoids and is characterized by its contoured major surface having a first convexly elevated portion of lesser size extending transversely inwardly from adjacent the central portion of one of a pair of opposite side edges and a second convexly elevated portion of a greater size extending transversely inwardly from adjacent the central portion of the other opposite side edge toward said first convexly elevated portion. The smaller elevated portion is adapted for application against the crease of a person having a smaller crease and the larger elevated portion is adapted for application against a crease of a person having a deeper crease. Hence, a single pad made as taught by this invention provides inventory for two sizes of crease. The number of molds needed for a full complement of sizes is reduced in half as is the number of different articles needed for a complete inventory of pad sizes.

The benefits of this invention will be understood better in the light of a description of a preferred embodiment that follows.

DESCRIPTION OF PREFERRED EMBODIMENTS

Figure 1:
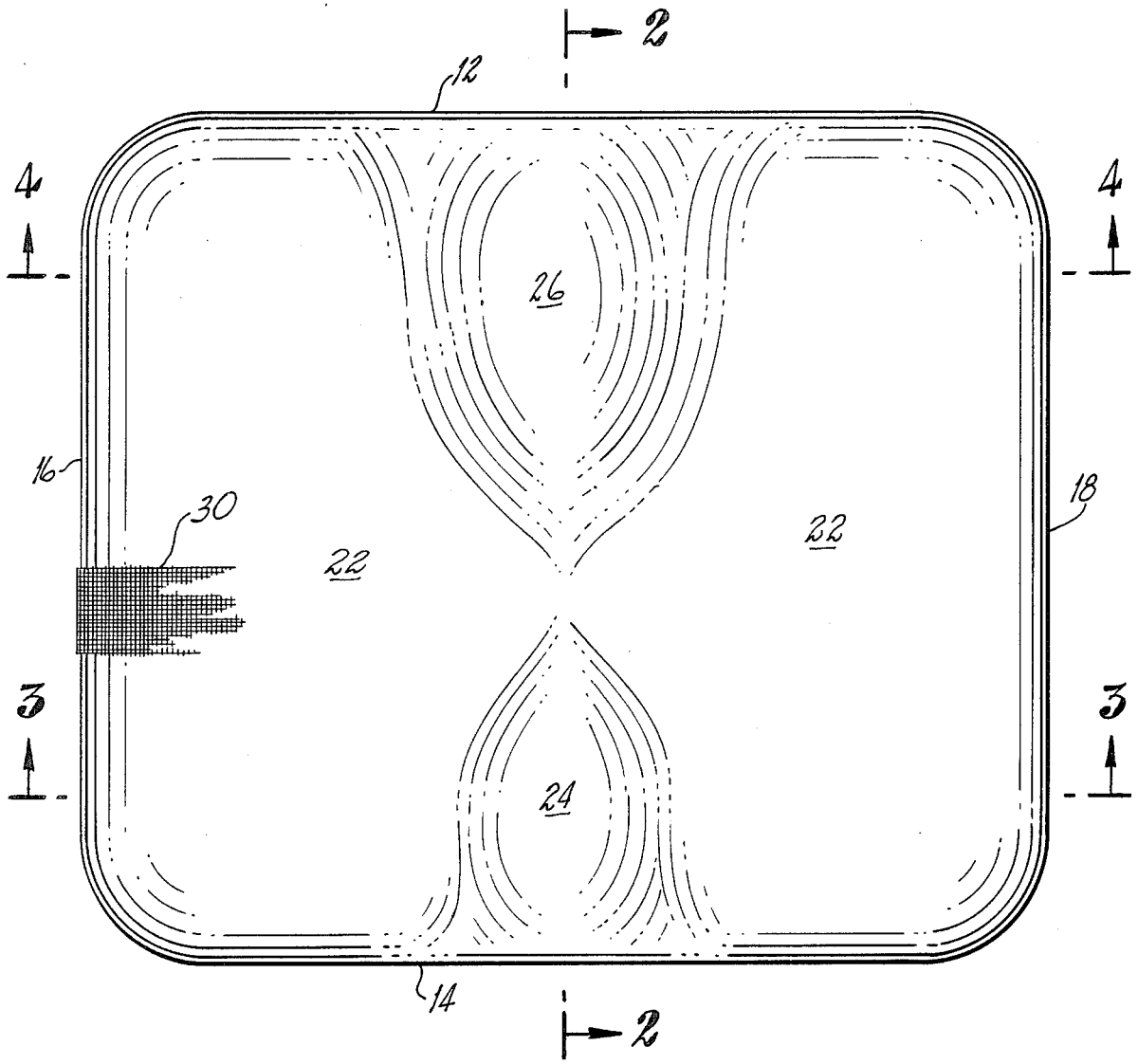
FIG. 1 is a plan view of a hemorrhoid relief cushion conforming to a preferred embodiment of this invention, showing a portion only of an optional cover.
Figure 2:
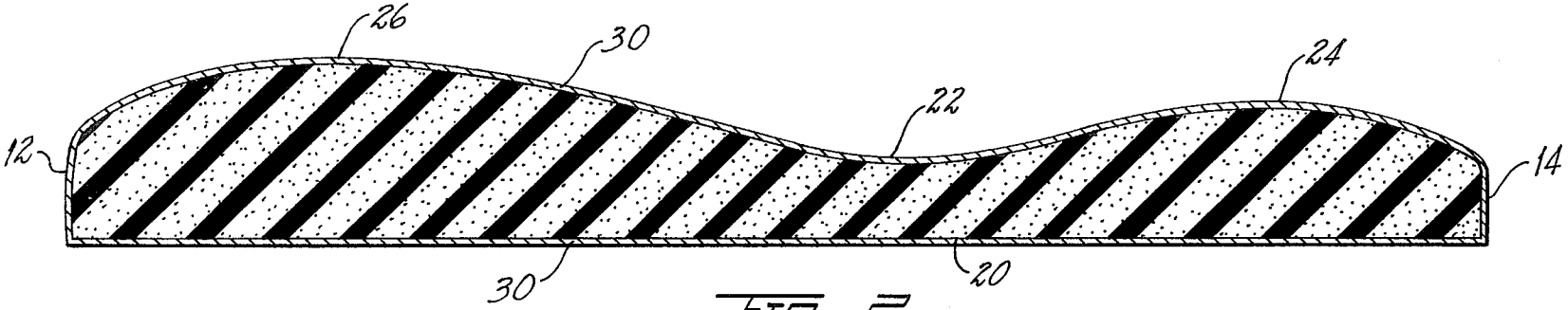
FIG. 2 is a sectional view taken along the line 2—2 of FIG. 1, showing the optional cover in place.
Figure 3:
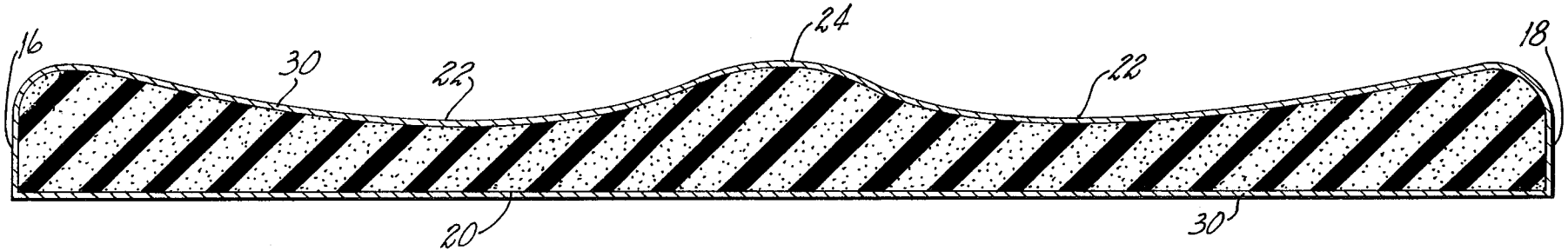
FIG. 3 is a sectional view along the line 3—3 of FIG. 1, showing the optional cover in place.
Figure 4:
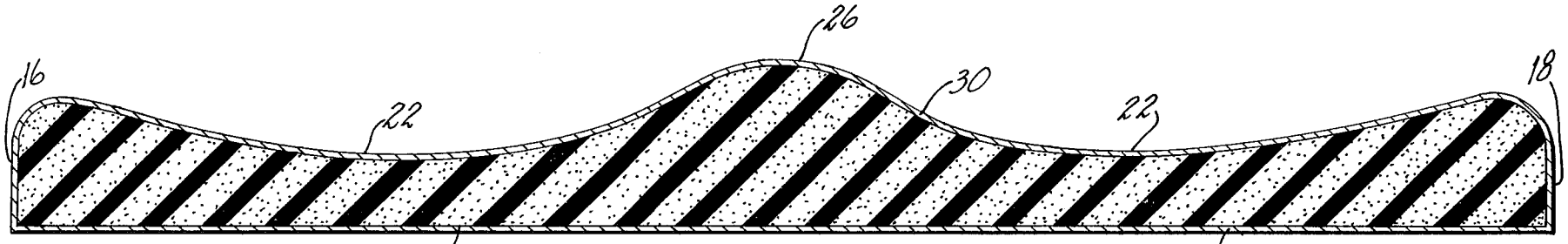
FIG. 4 is a sectional view along the line 4–4 of FIG. 1, showing the optional cover in place.

A hemorrhoid relief cushion conforming to this invention comprises a pad having a pair of opposite side edges 12 and 14. The corresponding ends of the latter are interconnected by end edges 16 and 18. The pad has a smooth lower major surface 20 adapted to face a seat to which said pad is applied and a contoured upper major surface 22 adapted to face the buttocks of a user.

The contoured upper surface 22 includes a first convexly elevated portion 24 extending inwardly from adjacent the central portion of side edge 14 toward side edge 12 and a second convexly elevated portion 26 extending inwardly from adjacent the central portion of side edge 12 toward convexly elevated portion 24. Elevated portions 24 and 26 are aligned with one another along line 2—2, are of different sizes and terminate at inner ends spaced from each other.

In the preferred embodiment, the cushion is essentially rectangular in outline. Opposite side edges 12 and 14 are straight, free of cut-out portions and approximately 17.5 inches long and opposite end edges 16 and 18 are approximately 15.5 inches long. The thickness of the pad throughout substantially its entire extent, is approximately ¾ inch, except for convexly rounded edge portions just within end edges 16 and 18 that are approximately one inch high and 1.5 inches wide, and first convexly elevated portion 24 that is approximately 3.5 inches long and 1.5 inches wide at its elongated peak (approximately ½ inches higher than than the main portion of contoured surface 22) and second convexly elevated portion portion 26 that is approximately 7 inches long and 1.5 inches wide along its rounded elongated peak about one inch higher than the main portion of contoured surface 22. These dimensions typify a pair of sizes for one cushion of an inventory. Other cushions in the inventory have pairs of elongated portions of other sizes.

The pad is composed of any well known material that has the requisite chemical and physical properties that enable it to conform to the shape of a mold when formed to retain pressure-compensating fitting properties against veins in the anus that cause discomfort due to pressure against hemorrhoids. The pad is preferably composed of spongy material that is light (that is, one having a specific gravity that does not exceed 0.8), that has a homogenous consistency, that is distortable during use so as to be capable of fitting its shape to that of any hemorrhoid within the crease between the buttocks of a user, that is substantially resistant to sag when stored, that deforms locally in response to continually applied pressure when confined between the buttocks of a user and a seat and that recovers in response to relief or release from pressure loads that cause it to deform, that remains substantially homogenous in the macroscopic sense and does not change in size significantly within a temperature range of expected exposure (0 to 100 degrees Fahrenheit). Any of several suitable organic materials, such as foamed polyurethane or foamed, cross-linked polyethylene, or the like, of sponge-like consistency that is moldable can be fabricated in a mold of suitable dual recessed shape to develop a desired dual crowned structure that characterizes the upper surface of a pad conforming to the present invention, in combination with an opposite surface that is relatively smooth and flat.

The foam used in the preferred embodiment of the invention is a flexible, molded, polymeric type of polyether urethane foam, that is stated by the supplier to be non-toxic and self-extinguishing. The foam has a density ranging between 2.8 to 5 lbs. per cubic ft. Seats made of this foam are produced by cold curing in an aluminum mold. The skin portion of the foam pad has a closer cell structure than the inner portion.

For a block of cubical configuration, the Indentor Load Deflection (ILD) ranges between 18 to 50 lbs. at 25% deflection and 51 to 140 lbs. at 65% deflection. The sag factor ratio of 65% to 25% deflection ranges between 2.8 minimum to 3.4 maximum. In the pad, whose dimensions are described previously, the ILD measured through the thickness of the first elongated convexly elevated portion 24, is 10.5 lbs. at 25% deflection, and is 15 lbs. at 25% deflection for the second elongated convexly elevated portion 26, and is 50.5 lbs. at 25% deflection for the main portion of the seat in the direction of the lower major surface.

The polyether urethane foam has a hysteresis loss at 25% return that does not exceed 12%. It has a ball rebound factor range from 55% to 65%, a minimal tensile strength of 17 lbs. per sq. in., a minimum elongation of 140% and a minimum tear of 1.7 lbs. per linear inch. Its dynamic fatigue for 100,000 cycles at 75% deflection develops a maximum height loss of 3% and maximum load loss of 8%.

The details of the foam used in the preferred embodiment are enumerated to enable one skilled in the art to make a product conforming to the best mode of this present invention.

The pad, after fabrication, is oriented to have its smooth lower major surface make pressurized engagement against a seat and its contoured upper major surface support the buttocks of a user. A relatively small person rotates the oriented cushion so that the relatively small convexly elevated portion 24 aligns with the crease between the buttocks of the small person. A relatively large person positions the cushion to align the relatively large, higher convexly elevated portion 22 with his crease by rotating the cushion about an angle of 180 degrees from the alignment suitable for the small person. The ability of the pad or cushion to provide comfort for hemorrhoid sufferers having different crease sizes results from the ability of the convexly elevated, elongated portions 24 and 26 to deform in pressure compensating relation so that each portion 22 or 24 develops a localized pressure most suitable to oppose localized pressure of blood vessels on hemorrhoids of a person of one or another particular size, and the ability to rotate the pad between the positions available for alignment.

The cushion may comprise a thin, flexible cover 30 (only a portion of which is illustrated in FIG. 1 and shown in place in the other drawings) of loosely woven polyester fabric approximately 10 to 20 mils thick to cover the pad. The open network of the cover allows the pad to breathe and avoids a high heat buildup in the user.

In a presently preferred embodiment of this invention, the pad is composed of a polyurethane composition that is spongy and has a smooth, relatively flat major surface that faces a seat on which the cushion is mounted and a contoured, dual crowned major surface that has a pair of spaced, aligned, convexly elevated, elongated portions spaced at their inner ends from one another and extending inward toward one another from adjacent the central portions of the opposite side edges of the pad.

Thus, if it is necessary to have an inventory of cushions of 34 different sizes to accommodate a population of people of different sizes who suffer from hemorrhoids, as suggested in the size distribution of the "CountourU" modular seating systems that are available, the present invention makes it possible to provide a full complement of 34 different sizes with only 17 different cushions, each providing a different pair of the 34 different sizes required, and a manufacturer need only have 17 molds instead of 34 molds on hand to produce a full complement of sizes.

This specification provides a detailed description of what is presently a preferred embodiment of this invention. It is understood that changes may be made without departing from the gist of the present invention. Reference to the latter may be obtained from the claimed subject matter that follows.

What is claimed is:

1. A hemorrhoid relief cushion comprising a pressure-compensating fitting pad of a resilient, solid cellular composition capable of exerting a slight but effective pressure on hemorrhoids that counteracts the pressures applied to said hemorrhoids by veins in the vicinity of the anus of a user, said pad having an essentially rectangular outline including a pair of side edges free of cutout portions and a contoured major surface, said contoured major surface including first and second elongated, continuously curved, convexly elevated portions, said first portion having a first elevational contour and being of relatively lesser size than said second portion and whose length extends transversely inwardly from adjacent the central portion of one of said side edges toward the other of said side edges, said second elongated, continuously curved, convexly elevated portion having a second elevational contour and being of relatively greater size that said first portion and whose length extends transversely inwarly from adjacent the central portion of the other of a said side edges toward said first elongated, continuously curved, convexly elevated portion, said first elongated, continuously curved, convexly elevated portion being constructed and arranged to relieve hemorrhoids within the creased of a first person having a relatively small crease and said second elongated, continuously curved, convexly elevated portion being constructed and arranged to relieve hemorrhoids within the crease of a second person having a relatively large crease.

2. A cushion as in claim 1, wherein said elongated, continuously curved, convexly elevated contoured portions ae aligned with one another with their inner ends spaced from one another.

3. A cushion as in claim 1, wherein said first elongated, continuously curved, convexly elevated contoured portion is shorter in length than said second elongated, continuously curved, convexly elevated contoured portion.

4. A cushion as in claim 3, wherein said first elongated, continuously curved, convexly elevated contoured portion is also lower in height than said second elongated continuously curved, convexly elevated, contoured portion.

5. A cushion as in claim 1, wherein said first elongated, continuously curved, convexly elevated, contoured portion is lower in height than said second elongated, continuously curved convexly elevated, contoured portion.

6. A cushion as in claim 1, wherein said pad is enclosed within a fabric cover having a thickness of 10 to 20 mils.

7. A cushion as in claim 1, wherein said pad is of essentially rectangular outline with a minimum pad thickness of approximately $\frac{3}{4}$ inch and a maximum thickness of approximately $1\frac{1}{2}$ inches in said elongated, continuously curved, convexly elevated, contoured portions.

8. A cushion as in claim 7, wherein said first elongated, continuously curved convexly elevated, contoured portion has a maximum thickness of approximately one inch and said second elongated, continuusly curved, convexly elevated, contoured portion has a thickness of approximately $1\frac{1}{2}$ inches.

9. A cushion as in claim 8, wherein said first elongated, continuously curved convexly elevated, contoured portion has a length of 3 to 5 inches and said second elongated, continuously curved; convexly elevated portion has a length of 5 to 8 inches.

10. A cushion as in claim 7, wherein said pad has a length of approximately 17.5 inches and a width of approximately 15.5 inches, said first elongated, continuously curved, convexly elevated, contoured portion is approximately 3 inches long and one inch thick, and said second elongated, continuously curved convexly elevated portion is approximately 6 inches long and 1.5 inches thick.

11. A cushion as in claim 1, wherein said pad is composed of polyurethane.

12. A cushion as in claim 11, wherein said polyurethane is foamed.

* * * * *